US006203908B1

(12) United States Patent
Cohen

(10) Patent No.: US 6,203,908 B1
(45) Date of Patent: Mar. 20, 2001

(54) COMPOSITE ARMOR

(76) Inventor: Michael Cohen, Kibbutz Kfar Etzion, Mobile Post North Yehuda, 90200 (IL)

( * ) Notice: Subject to any disclaimer, the term of this patent is extended or adjusted under 35 U.S.C. 154(b) by 0 days.

(21) Appl. No.: 09/314,646

(22) Filed: May 19, 1999

Related U.S. Application Data

(63) Continuation-in-part of application No. 09/944,343, filed on Oct. 6, 1997, now Pat. No. 5,972,819, and a continuation-in-part of application No. 09/048,628, filed on Mar. 26, 1998, now Pat. No. 6,112,635, which is a continuation-in-part of application No. 08/704,432, filed on Aug. 26, 1996, now Pat. No. 5,763,813.

(30) Foreign Application Priority Data

Oct. 9, 1996 (IL) ..... 119386

(51) Int. Cl.[7] ..... F41H 5/02; D02G 3/00

(52) U.S. Cl. ..... 428/397; 428/911; 89/36.02; 89/36.04

(58) Field of Search ..... 428/174, 911, 428/702, 156, 212, 329, 364, 397; 2/2.5; 89/36.02, 36.04, 36.07, 36.08, 36.11, 36.12; 501/127, 153

(56) References Cited

U.S. PATENT DOCUMENTS

| | | | | |
|---|---|---|---|---|
| 3,523,057 | | 8/1970 | Buck | 161/116 |
| 4,179,979 | | 12/1979 | Cook et al. | 89/36 A |
| 4,602,385 | | 7/1986 | Warren | 2/2 |
| 5,361,678 | | 11/1994 | Roopchand et al. | 89/36.02 |
| 5,972,819 | * | 10/1999 | Cohen | 501/127 |

FOREIGN PATENT DOCUMENTS

| | | | |
|---|---|---|---|
| 101437 | 9/1897 | (DE) . | |
| 1578324 | 1/1970 | (DE) . | |
| 39 38 741 A1 | 9/1991 | (DE) | F41H/1/02 |
| 0 499 812 A1 | 8/1992 | (EP) | F41H/1/02 |
| 1081464 | 8/1967 | (GB) . | |
| 1142689 | 2/1969 | (GB) | F41H/5/00 |
| 1352418 | 5/1974 | (GB) . | |
| 2272272 | 5/1994 | (GB) . | |

OTHER PUBLICATIONS

Rafael, System Concept of Applique Flexible Ceramic Armor (FCA), Technical Proposal, pp. 3–41, Jun. 1993.
Plasan Sasa Plastic Products, Price List, Mar. 31, 1998.
Coors Porcelain Company Brochure, 1 page.
Ballistic Materials and Penetration Mechanics, Chapter 6, Roy C. Laible, pp. 135–142, 1980.
14th International Symposium on Ballistics, Quebec, Canada, The Performance of Lightweight Ceramic Faced Armours Under Ballistic Impact, Drs. C. Navarro, M.A. Martinez, R. Cortes and V. Sanchez–Galvez, pp. 573–577, Sep. 1993.

(List continued on next page.)

*Primary Examiner*—Donald J. Loney
(74) *Attorney, Agent, or Firm*—Fulbright & Jaworski L.L.P.

(57) ABSTRACT

The invention provides a composite armor for absorbing and dissipating kinetic energy from high velocity projectiles, comprising a panel provided with a layer of a plurality of high density ceramic bodies, the bodies having a specific gravity of at least 2 and being made of a material selected from the group consisting of ceramic material which does not contain aluminium oxide and ceramic material having an aluminium oxide content of not more than 80%, each of the bodies being substantially cylindrical in shape, with at least one convexly curved end face, and each of the bodies having a major axis substantially perpendicular to the axis of its respective curved end face, wherein the ratio D/R between the diameter D of each of the cylindrical bodies and the radius R of curvature of the respectively convexly curved end face of each of the bodies is at least 0.64:1, and wherein the bodies are arranged in a plurality of adjacent rows and columns, the major axis of the bodies being in substantially parallel orientation with each other and substantially perpendicular to an adjacent surface of the panel.

13 Claims, 3 Drawing Sheets

OTHER PUBLICATIONS

Coors Ceramic Company, Armor Products Brochure, Coors Alumina Armor Materials, Data Sheet 52–96, 2 pages, 1990.

Alumina, Processing, Properties and Applications, E. Dorre & H. Hubner, pp. 278–283, 1984.

* cited by examiner

FIG. 1
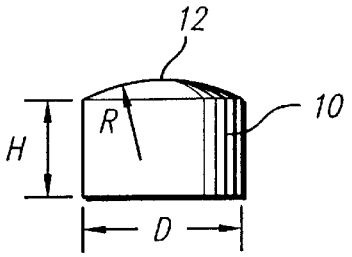
FIG. 2
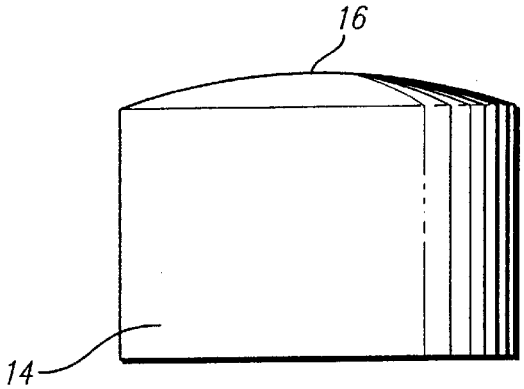
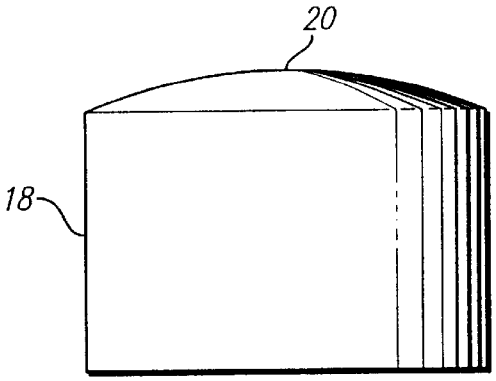
FIG. 3
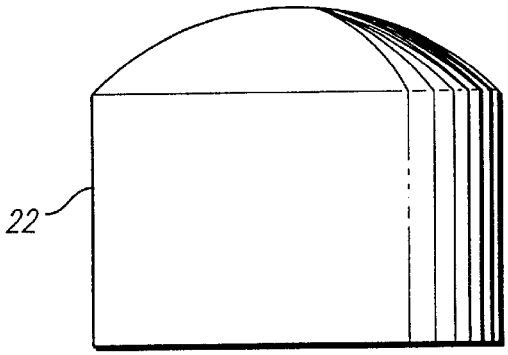
FIG. 4

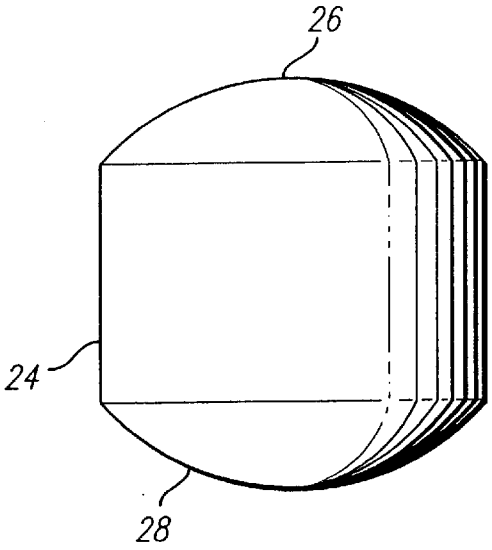
FIG. 5
FIG. 8
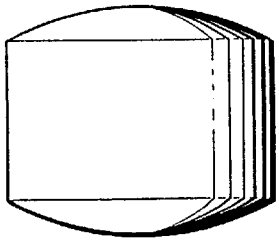
FIG. 9
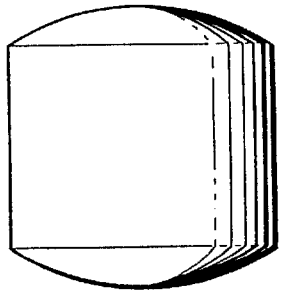
FIG. 10
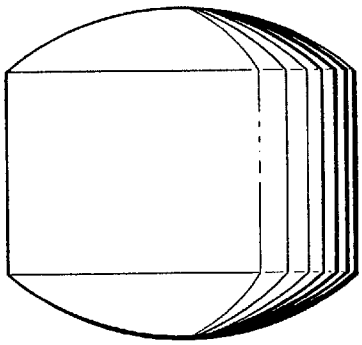
FIG. 11
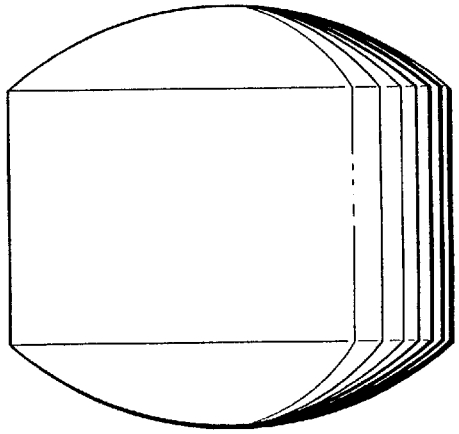

COMPOSITE ARMOR

The present specification is a continuation-in-part U.S. Ser. No. 9/944,343, filed Oct. 6th, 1997 now U.S. Pat. No. 5,972,819, as well as being a continuation-in-part of U.S. Ser. No. 09/048,628, filed Mar. 26th, 1998 now U.S. Pat. No. 6,112,635, which in turn is a continuation-in-part of U.S. Ser. No. 08/704,432, filed Aug. 26th, 1996 and now granted as U.S. Pat. No. 5,763,813.

The present invention relates to a composite armor panel. More particularly, the invention provides improved ceramic bodies for use in armored panels providing lightweight ballistic protection which may be worn by the user, and for protecting mobile equipment and land, air and amphibious vehicles against high-speed fire-arm projectiles or fragments. The invention also includes a composite armor and ballistic armor containing said bodies.

There are three main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. Due to its weight, such armor is quite unsuitable for light vehicles such as automobiles, jeeps, light boats, or aircraft, whose performance is compromised by steel panels having a thickness of more than a few millimeters.

Armor for vehicles, including land, airborne and amphibious vehicles, is expected to prevent penetration of bullets of any weight, even when impacting at a speed in the range of 700 to 1000 meters per second. The maximum armor weight which is acceptable for use on light vehicles varies with the type of vehicle, but generally falls in the range of 40 to 100 kg/m$^2$.

A second consideration is cost. Overly complex armor arrangements, particularly those depending entirely on synthetic fibers, can be responsible for a notable proportion of the total vehicle cost, and can make its manufacture non-profitable.

Fairly recent examples of armor systems are described in U.S. Pat. No. 4,836,084, disclosing an armor plate composite including a supporting plate consisting of an open honeycomb structure of aluminium; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Ceramic materials are nonmetallic, inorganic solids having a crystalline or glassy structure, and have many useful physical properties, including resistance to heat, abrasion and compression, high rigidity, low weight in comparison with steel, and outstanding chemical stability.

Such properties have long drawn the attention of armor designers, and solid ceramic plates, in thicknesses ranging from 3 mm. for personal protection to 50 mm. for heavy military vehicles, are commercially available for such use.

Much research has been devoted to improving the low tensile and low flexible strength and poor fracture toughness of ceramic materials; however, these remain the major drawbacks to the use of ceramic plates and other large components which can crack and/or shatter in response to the shock of an incoming projectile.

Light-weight, flexible armored articles of clothing have also been used for many decades, for personal protection against fire-arm projectiles and projectile splinters. Examples of this type of armor are found in U.S. Pat. No. 4,090,005. Such clothing is certainly valuable against low-energy projectiles, such as those fired from a distance of several hundred meters, but fails to protect the wearer against high-velocity projectiles originating at closer range. If made to provide such protection, the weight and/or cost of such clothing discourages its use. A further known problem with such clothing is that even when it succeeds in stopping a projectile the user may suffer injury due to indentation of the vest into the body, caused by too small a body area being impacted and required to absorb the energy of a bullet.

A common problem with prior art ceramic armor concerns damage inflicted on the armor structure by a first projectile, whether stopped or penetrating. Such damage weakens the armor panel, and so allows penetration of a following projectile, impacting within a few centimeters of the first.

The present invention is therefore intended to obviate the disadvantages of prior art ceramic armor, and to provide ceramic bodies for deployment in composite armor panels which are effective against armor-piercing, high-velocity, small-caliber fire-arm projectiles, yet which are of light weight and therefore can be incorporated in a composite panel having a weight of less than 45 kg/m$^2$, which is equivalent to about 9 lbs/ft$^2$ when used in personal armor and light vehicles and which can be of greater weight when used in heavier vehicles and/or in armor against heavier ammunition.

In the field of armor material, the terms "surface mass" and "weight" are often used interchangeably, as will be done in the present specification. Another way of expressing the above concept is to relate to "a surface weight which does not exceed 450 Neuton/m$^2$."

A further object of the invention is to provide an armor panel which is particularly effective in arresting a plurality of projectiles impacting upon the same general area of the panel.

Thus, according to the present invention there is now provided a ceramic body for deployment in composite armor, said body being substantially cylindrical in shape, with at least one convexly curved end face, wherein the ratio D/R between the diameter D of said cylindrical body and the radius R of curvature of said at least one convexly curved end face is at least 0.64:1.

In preferred embodiments of the present invention, the ratio D/R between the diameter D of said cylindrical body and the radius R of curvature of said at least one convexly curved end face is at least 0.85:1.

In especially preferred embodiments of the present invention the ratio D/R between the diameter D of said cylindrical body and the radius R of curvature of said at least one convexly curved end face is between about 0.85:1 and 1.28:1.

In further preferred embodiments of the present invention the ratio D/R between the diameter D of said cylindrical body and the radius R of curvature of said at least one convexly curved end face is at least 1.28:1.

U.S. Pat. No. 4,665,794 discloses the use of ceramic pieces of tubular of spherical shape in a composite armor environment. U.S. Pat. Nos. 4,179,979; 3,705,558; and 4,945,814 disclose the use of ceramic spheres in a composite armor arrangement. None of said patents, however, teach or suggest the specific shapes of ceramic bodies as defined herein, and the surprisingly superior properties thereof as shown in comparative Example A hereinafter.

The armor plates described in U.S. Pat. No. 5,763,813 and U.S. application Ser. No. 09/048,628 are made using ceramic pellets made substantially entirely of aluminum oxide. In U.S. application Ser. No. 08/944,343 the ceramic bodies are of substantially cylindrical shape having at least one convexly-curved end-face, and are preferably made of aluminium oxide.

Obviously, other ceramic materials having a specific gravity equal to or below that of aluminium oxide, e.g., boron carbide with a specific gravity of 2.45, silicon carbide with a specific gravity of 3.2 and silicon aluminum oxynitride with a specific gravity of about 3.2 can be used in place of aluminum oxide in the composite armor of the present invention.

Thus, oxides, nitrides, carbides and borides of magnesium, zirconium, tungsten, molybdium, titanium and silica can be used and especially preferred for use in the present invention are pellets selected from the group consisting of boron carbide, titanium diboride, silicon carbide, magnesium oxide, silicon aluminum oxynitride in both its alpha and beta forms and mixtures thereof.

Ceramic bodies which are substantially cylindrical in shape and which have at least one convexly curved end face are known and are manufactured by various companies in Israel, Italy, India, Germany and the United States as a grinding media. These ceramic bodies, however, have been found to be inferior in properties for use in a composite armor panel, as described in comparative Example 1 hereinafter, in that these bodies prepared with a height H of 7.5 mm and a diameter D of 12.8 mm have been found to shatter when placed in a crushing press exerting between 1.9 and 2.5 tons of pressure, while the ceramic bodies of the present invention, having the same height and diameter but having a radius of curvature smaller than that of said prior art ceramic bodies as herein defined, surprisingly shatter in the same conditions at a pressure in excess of 5 tons, and especially preferred embodiments of the present invention shatter only after being subjected to pressures in excess of 6 and even 7 tons.

As explained and exemplified hereinafter, this surprisingly superior performance of the ceramic bodies of the present invention, which expresses itself also in stopping power relative to high-velocity projectiles, is achieved by varying the radius of curvature of said at least one convexly curved end face of said body, which variation is neither taught nor suggested in the prior art, as further evidenced by the fact that all of the manufacturers of such bodies heretofore have been manufacturing these bodies with a radius of curvature substantially different than that now discovered and proposed in the present invention.

Thus, referring to a preferred series of ceramic bodies prepared according to the present invention, these bodies are characterized in that the relative ratios H/D/R of the height H of said cylindrical bodies, excluding the height of their respective convexly curved end faces, the diameter of said cylindrical bodies D, and the radius R of curvature of said at least one convexly curved end face is between about 7.5:12.8:9 and 7.5:12.8:20, while in the prior art ceramic bodies of substantially cylindrical shape with at least one convexly curved end face the relative ratios of the height H of said cylindrical bodies, excluding the height of their respective convexly curved end faces, the diameter of said cylindrical bodies D, and the radius R of curvature of said at least one convexly curved end face is between about 7.5:12.8:25 and 7.5:12.8:30.

While the bodies of the present invention and those of the prior art, presented for comparative purposes, all were chosen with a height H of 7.5 mm for uniformity of comparative purposes, it will be understood that the bodies of the present invention can be prepared with different heights of e.g. between 6 mm and 20 mm, depending on the ballistic challenge which they are designed to meet and will still constitute part of the present invention as long as the relative ratios D/R, as defined herein, are maintained.

Similarly, the diameters of the bodies of the present invention can be varied, as shown e.g. with reference to FIGS. 8–11 hereinafter, as long as the relative ratios D/R, as defined herein, are maintained.

In a further preferred embodiment of the present invention, said ceramic body is provided with two convexly curved end faces, wherein the ratio D/R between the diameter D of said cylindrical body and the radius R of curvature of each of said convexly curved end faces is at least 0.64:1.

In another aspect of the present invention there is provided a composite armor for absorbing and dissipating kinetic energy from high velocity projectiles, comprising a panel provided with a layer of a plurality of high density ceramic bodies, said bodies having a specific gravity of at least 2 and being made of a material selected from the group consisting of ceramic material which does not contain aluminium oxide and ceramic material having an aluminium oxide content of not more than 80%, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel.

As will be realized, said panel will normally have substantially parallel surfaces and the convexly curved faces of said bodies will be directed to one of said surfaces when the major axis of said bodies are substantially perpendicular to an adjacent surface of said panel, however it is contemplated that said panels can also be curved, in which case said description does not exactly apply.

In preferred embodiments of this aspect of the present invention there is provided a composite armor for absorbing and dissipating kinetic energy from high velocity projectiles, comprising a panel consisting essentially of a single internal layer of a plurality of high density ceramic bodies directly bound and retained in panel form by a solidified material, said bodies having a specific gravity of at least 2 and being made of a material selected from the group consisting of ceramic material which does not contain aluminium oxide and ceramic material having an aluminium oxide content of not more than 80%, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other.

In especially preferred embodiments of the present invention said panel has an inner and an outer surface, said outer surface faces the impact side and said ceramic bodies are arranged in a plurality of adjacent rows, the cylinder axis of said bodies being substantially parallel with each other and perpendicular to the surfaces of the panel with the convexly curved end faces directed to the outer surface and said composite armor further comprises an inner layer adjacent said inner surface of said panel, said inner layer being formed from a plurality of adjacent layers, each layer comprising a plurality of unidirectional coplanar anti-ballistic fibers embedded in a polymeric matrix, the fibers of adjacent layers being at an angle of between about 45° to 90° to each other.

The invention also provides a ballistic armor material for absorbing and dissipating kinetic energy from high velocity projectiles, comprising a panel provided with a layer of a plurality of high density ceramic bodies, said bodies having a specific gravity of at least 2 and being made of a material selected from the group consisting of ceramic material which does not contain aluminium oxide and ceramic material having an aluminium oxide content of not more than 80%, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a side view of a preferred embodiment of the ceramic body according to the invention;

FIG. 2 is a cross-sectional view of a specific embodiment of the present invention of defined dimensions;

FIG. 3 is a cross-sectional view of a second specific embodiment of the present invention of defined dimensions;

FIG. 4 is a cross-sectional view of a third specific embodiment of the present invention of defined dimensions;

FIG. 5 is a side view of a ceramic body having two curved end faces;

FIG. 8 is a cross-sectional view of a further specific embodiment of the present invention of defined dimensions;

FIG. 9 is a cross-sectional view of yet a further specific embodiment of the present invention of defined dimensions;

FIG. 10 is a cross-sectional view of another specific embodiment of the present invention of defined dimensions; and FIG. 11 is a cross-sectional view of yet another specific embodiment of the present invention of defined dimensions.

Figure 6:
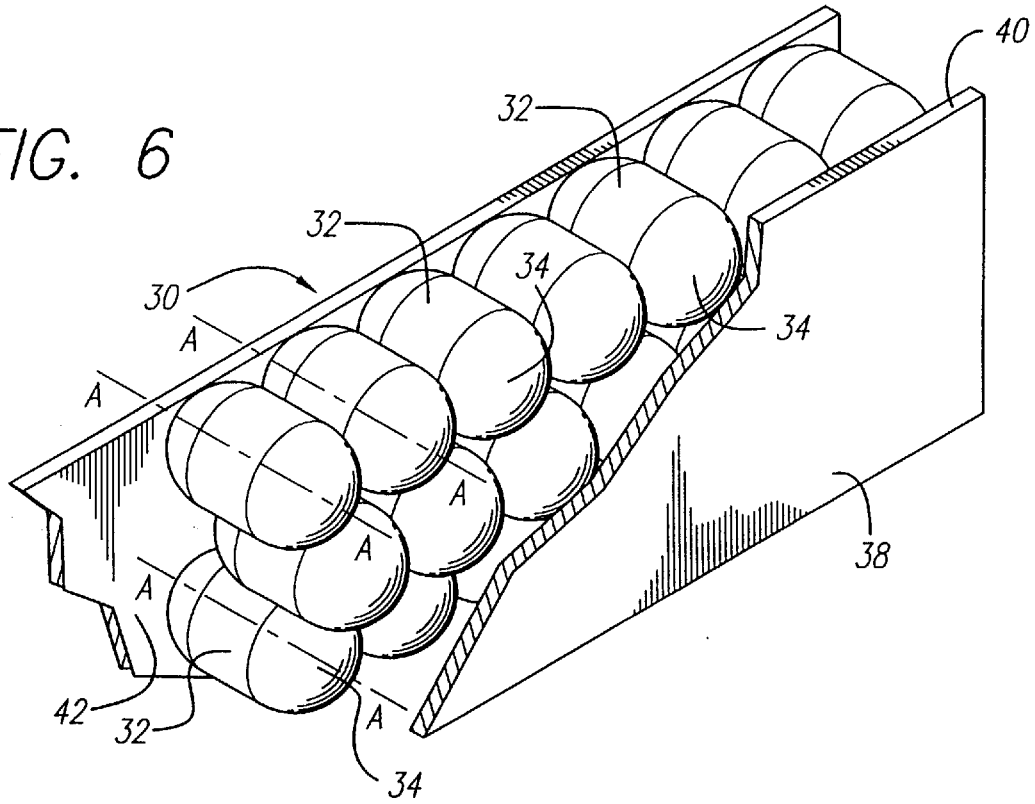
FIG. 6 is a fragmented perspective view of a panel using ceramic bodies.

There is seen in FIG. 1 a ceramic body 10 for deployment in a composite armor panel. The body 10 is substantially cylindrical in shape, and has a convexly curved end face 12. The radius of curvature of the convexly curved end face 12 is indicated by the letter R. The diameter of said cylindrical body is indicated by the letter D, and the height of said cylindrical body, excluding the height of said convexly curved end face, is indicated by the letter H.

Regarding composition of the ceramic bodies used in the present invention, the preferred type is alumina, having an $Al_2O_3$ content of at least 85% by weight and a specific gravity of at least 2.5. Advantageously, the $Al_2O_3$ content is at least 90% by weight and the specific gravity 3 or higher. Hardness is at least 9 on the Mohs scale.

Referring now to FIG. 2, there is seen a specifically dimensioned body 14 according to the present invention. The radius of curvature R of the convexly curved end face 16 is 20 mm, and the height H of the cylindrical body, excluding the height of said convexly curved end face, is 7.5 mm. The ratio D/R between the diameter D of said cylindrical body, which is 12.8 mm, and the radius of curvature R which, in this embodiment is 20 mm, is 12.8/20=0.64. Composition of the ceramic is the same as for the body described with reference to FIG. 1.

FIG. 3 illustrates a ceramic body 18 for use in armor having yet a smaller radius of curvature of said convex end face 20, which brings a further improvement in shatter resistance of the body 18 and thereby further protection against ballistic challenge. In this embodiment, the radius of curvature R of the convexly curved end face 20 is 15 mm, and the height H of the cylindrical body, excluding the height of said convexly curved end face, is 7.5 mm. The ratio D/R between the diameter D of said cylindrical body, which is 12.8 mm, and the radius of curvature R which, in this embodiment is 15 mm, is 12.8/15=0.85. Composition of the ceramic is the same as for the body described with reference to FIG. 1.

Seen in FIG. 4 is a ceramic body 22 of even more preferred dimensions, The radius of curvature R of the convexly curved end face is 9 mm, and the height H of the cylindrical body, excluding the height of said convexly curved end face, is 7.5 mm. The ratio D/R between the diameter D of said cylindrical body, which is 12.8 mm, and the radius of curvature R which, in this embodiment is 9 mm, is 12.8/9=1.4. Composition of the ceramic is the same as for the body described with reference to FIG. 1.

Referring now to FIG. 5, there is depicted a ceramic body 24 similar to that described with reference to FIG. 2, but provided with two convexly-curved end faces 26, 28. The body diameter: end radius ratio is the same as defined in FIG. 2. This configuration is, in fact, the most preferred for all embodiments of the present invention, in that the effect of the curved end faces act, not only in reaction to the oncoming projectile, but also against the backing provided for the panel.

The convex curve at each end of the body further increases shatter resistance under impact, and is furthermore more convenient in use, as no special care need be taken regarding orientation of the body during subsequent assembly in an armor panel.

Referring now to FIG. 6, there is seen a composite armor for absorbing and dissipating kinetic energy from high velocity projectiles, typically rifle bullets and shell and grenade fragments.

A panel 30 is provided with a layer of a plurality of high density ceramic bodies 32. These are substantially cylindrical in shape, with at least one convexly curved end face 34.

The major axis M of each pellet is substantially perpendicular to the axis of its respective curved end face 34. The ratio body diameter:end radius is at least 0.64:1. The bodies 32 are arranged in a plurality of adjacent rows and columns. The major axes M of the bodies 32 are substantially parallel to each other, and perpendicular to the panel surface 38.

In the present embodiment the bodies 32 are retained between an outer steel sheet 40 and an inner layer 42 preferably made of a high-strength anti-ballistic fibers such as multiple layers of Kevlar®, Dyneema®, Goldshield®, a material known by its trade name of Famaston, fiberglass, etc., which steel sheets might be present when the bodies of the present invention are incorporated in an armored vehicle, although it has been found that the outer steel sheet is unnecessary for achieving the stopping effect of panels incorporating the bodies of the present invention.

As will be noted, preferred embodiments of the present invention will include at least one inner layer, preferably incorporating anti-ballistic fibers such as glass, polyolefins, polyvinylalchohol, polyaramids and liquid crystalline polymers. Preferably said fibers will have a modulus greater than 150 g/denier and a tensile strength of more than 7 g/denier.

Figure 7:
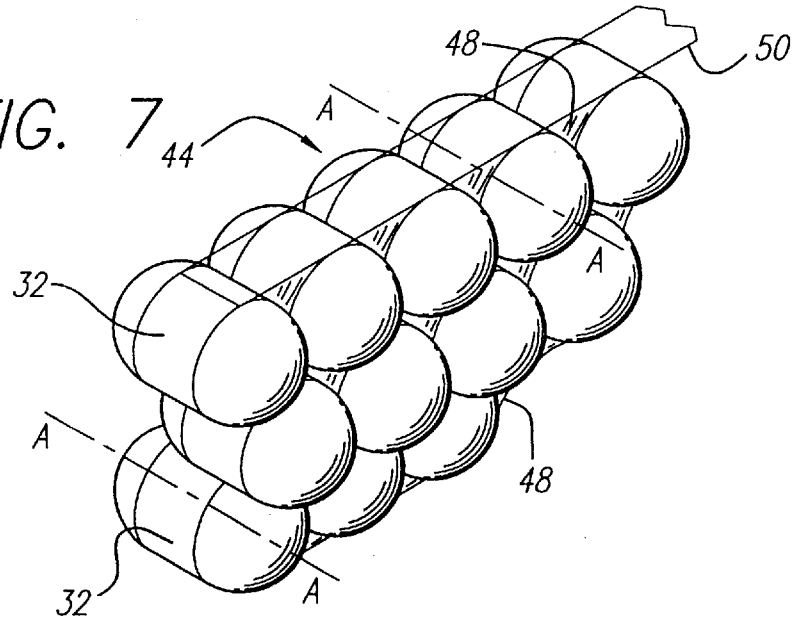
FIG. 7 is a perspective view of a small section of a panel wherein a castable material fills the voids between bodies.

FIG. 7 illustrates a further composite armor for absorbing and dissipating kinetic energy from high velocity projectiles. A panel is provided with a single internal layer of a plurality of high density ceramic bodies. The bodies are bound and retained in panel form by a solidified material. Such material is suitably an epoxy resin for applications where weight is the overriding consideration, such as for use in personal armor or for aircraft. For boats and land vehicles an aluminium alloy material gives improved protection in exchange for some weight increase. The bodies 32, which have been previously described with reference to FIG. 6, are arranged in a plurality of adjacent rows and columns. The major axes M of the bodies 32 are substantially parallel to each other, and perpendicular to the panel surface 50.

Seen in FIGS. 8–11 are various ceramic bodies of different preferred dimensions. Thus, in FIGS. 8 and 9 the diameter D of said cylindrical bodies are 19, while in FIGS. 10 and 11 the diameter D is 25.4 and 32, respectively. In these bodies, the radius of curvature R of each of the convexly curved end faces are 20 mm, 16.54 mm, 20 mm, and 25 mm, whereby the ratio D/R between the diameter D of said cylindrical bodies and the radius of curvature R are respectively 0.95:1, 1.148:1, 1.27:1, and 1.28:1, respectively. Composition of the ceramic is the same as for the body described with reference to FIG. 1.

COMPARATIVE EXAMPLE A

A plurality of ceramic bodies of substantially cylindrical shape and having at least one convexly curved end face were ordered from Wheelabrator-Allevard (Italy), Jyoti Ceramic Industries Pvt. Ltd. (India), Spherotech GmbH (Germany), and Union Process (USA), wherein each of said ceramic bodies had a height H of 7.5 mm, a diameter D of 12.8 mm and a radius of curvature R, respectively, of 33 mm, 28 mm, 34 mm and 31 mm, and were compared with different ceramic bodies prepared according to the present invention, having a radius of curvature, respectively, of 20 mm, 15 mm, 10 mm, 9.5 mm and 9 mm.

These ceramic bodies were prepared from $Al_2O_3$ ceramic powder, ground to a size of about 180–200 microns. The ground powder, after cleaning, is pressed in a suitable mold with a hydraulic press, having a pressure of at least 50 tons, to form the desired bodies. The bodies which are formed are then placed in an oven at a temperature of at least 700° C. for at least 10 and preferably at least 48 hours.

Each of said ceramic bodies was placed in a hydraulic press Model M.50/1, manufactured by Taamal Mizra, Kibbutz Mizra, Israel, incorporating a C-57-G piston, and capable of generating 50 tons of pressure. The shattering point of each body was recorded, as follows:

| | |
|---|---|
| Ceramic body from Italy | 2.1 tons |
| Ceramic body from India | 3.3 tons |
| Ceramic body from Germany | 1.9 tons |
| Ceramic body from the US | 2.5 tons |
| 20 mm R body of the present invention: | 5 tons |
| 15 mm R body of the present invention: | 6 tons |
| 10 mm R body of the present invention: | 7.3 tons |
| 9.5 mm R body of the present invention: | 7.4 tons |
| 9 mm R body of the present invention: | 7.5 tons |

Panels formed from ceramic bodies according to the present invention were subjected to ballistic tests and exhibited surprisingly superior properties.

Table I is a reproduction of a test report relating to ballistic resistance tests carried out on a panel, as shown in FIG. 6, containing an array of bodies of the dimensions shown in FIG. 9, bounded by epoxy and without steel sheet 40.

The panel of FIG. 6 was provided with an inner layer 17 mm thick made of Dyneema®, and a further 6.35 mm thick backing layer of aluminum.

As shown in Table I, the ammunition used in the first test shot was a high-velocity, 20 mm fragment STM projectile, while the remaining test shots fired at the same 24.5×24.5 inch panel according to the present invention, were with 14.5 mm armor piercing B-32 bullets, with increasingly higher values of average velocity. As will be noted, only at an average velocity of 3,328 ft/sec did the eighth armor piercing B-32 bullet penetrate the panel, which had already sustained 7 previous hits, when the standard is the ability to withstand only 4 hits per panel of the same size at lower velocities.

TABLE 1

H. P. WHITE LABORATORY, INC.
DATA RECORD
BALLISTIC RESISTANCE TESTS

| | | | |
|---|---|---|---|
| Date Rec'd: | 6/18/97 | Job No.: | 7403-01 |
| via: | HAND CARRIED | Test Data: | 6/19/97 |
| Returned: | HAND CARRIED | Customer: | I.B.C. |
| File (HPWLI): | IBC-1.PIN | | |
| TEST PANEL | | | |
| Description: | PROPRIETARY | Sample No.: | ARRAY-1/TARGET-1 |

TABLE 1-continued

H. P. WHITE LABORATORY, INC.
DATA RECORD
BALLISTIC RESISTANCE TESTS

| | | | |
|---|---|---|---|
| Manufacturer: | PROPRIETARY | Weight: | 78.3 lbs. (a) |
| Size: | 24.5 × 24.5 in. | Hardness: | NA |
| Thicknesses: | na | Plies/Laminates: | NA |
| Avg. Thick.: | na in. | | |

AMMUNITION

| | |
|---|---|
| (1): 20 mm Frag. Sim. | Lot No.: |
| (2): 14.5 mm B-32 | Lot No.: |
| (3): | Lot No.: |
| (4): | Lot No.: |

SET-UP

| | | | |
|---|---|---|---|
| Vel. Screens: | 15.0 ft. & 35.0 ft. | Range to Target: | 40.6 ft. |
| Shot Spacing: | PER CUSTOMER REQUEST | Range Number: | 3 |
| Barrel No./Gun: | 20–30 MM/14.5-1 | Backing Material: | NA |
| Obliquity: | 0 deg. | Target to Wit.: | 6.0 in. |
| Witness Panel: | .020" 2024-T3 ALUM. | Conditioning: | 70 deg. F. |

APPLICABLE STANDARDS OR PROCEDURES (1): PER CUSTOMER REQUEST
(2):
(3):

| Shot No. | Ammo. | Time s × 10-5 | Velocity ft/s | Time s × 10-5 | Velocity ft/s | Avg. Vel ft/s | Vel. Loss ft/s | Stk. Vel. ft/s | Penetration | Footnotes |
|---|---|---|---|---|---|---|---|---|---|---|
| 1 | 1 | 487.8 | 4100 | 488.0 | 4098 | 4099 | 95 | 4004 | None | |
| 2 | 2 | 723.5 | 2764 | 723.7 | 2764 | 2764 | 7 | 2757 | None | |
| 3 | 2 | 715.8 | 2794 | 716.1 | 2793 | 2794 | 7 | 2787 | None | |
| 4 | 2 | 714.1 | 2801 | 714.4 | 2800 | 2800 | 7 | 2793 | None | |
| 5 | 2 | 703.9 | 2841 | 704.1 | 2840 | 2840 | 7 | 2833 | None | |
| 6 | 2 | 653.1 | 3062 | 653.2 | 3062 | 3062 | 7 | 3035 | None | |
| 7 | 2 | 640.1 | 3124 | 640.3 | 3124 | 3124 | 7 | 3117 | None | |
| 8 | 2 | 600.8 | 3329 | 601.0 | 3328 | 3328 | 7 | 3321 | Bullet/Spall | |

FOOTNOTES:
REMARKS:
Local BP-29.88 in. Hg, Temp. = 72.0 F., RH = 69%
(a) WEIGHT DOES NOT INCLUDE 1.3 lbs. FOR SOFT WOVEN ARAMID COVER.

A plurality of ceramic bodies of substantially cylindrical shape and having one convexly-curved end face, wherein all of said bodies are of equal size and shape, each having a height H of 7.5 mm, a diameter D. Of 12.8 mm and a radius of curvature R, respectively of 20 mm, 15 mm, 10 mm, 9.5 mm and 9 mm were prepared from aluminum oxide, SiAION, silicon carbide and boron carbide and were placed sequentially in a hydraulic press Model M.50/1 manufactured by Taamal Mizra, Kibbutz Mizra, Israel, incorporating a C-57-G piston, and capable of generating 50 tons of pressure and the shattering points of each body was recorded as follows:

TABLE 2

| | $Al_2O_3$ alumina | SiAlON | Silicon Carbide (SiC) | Boron Carbide ($B_4C$) |
|---|---|---|---|---|
| 20 mm R body | 5 | 5.9 | 5.9 | 6.4 |
| 15 mm R body | 6 | 7.1 | 7.1 | 7.7 |
| 10 mm R body | 7.3 | 8.6 | 8.6 | 9.4 |
| 9.5 mm R body | 7.4 | 8.7 | 8.7 | 9.5 |
| 9 mm R body | 7.5 | 8.8 | 8.8 | 9.6 |

Considering that SiAION is lighter in weight than aluminum oxide and has a surprisingly greater shattering strength, it is ideally suited for use in the composite armor plates of the present invention, as is Silicon Carbide and Boron Carbide.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor for absorbing and dissipating kinetic energy from high velocity projectiles, comprising a panel provided with a layer of a plurality of high density ceramic bodies, said bodies having a specific gravity of at least 2 and being made of a material selected from the group consisting of ceramic material which does not contain aluminium oxide and ceramic material having an aluminium oxide content of not more than 80%, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel.

2. A composite armor for absorbing and dissipating kinetic energy from high velocity projectiles, comprising a panel consisting essentially of a single internal layer of a plurality of high density ceramic bodies directly bound and retained in panel form by a solidified material, said bodies having a specific gravity of at least 2 and being made of a material selected from the group consisting of ceramic material which does not contain aluminium oxide and ceramic material having an aluminium oxide content of not more than 80%, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other.

3. A composite armor according to claim 1, wherein said panel has an inner and an outer surface, said outer surface facing the impact side and said ceramic bodies are arranged in a plurality of adjacent rows, the cylinder axis of said bodies being substantially parallel with each other and perpendicular to the surfaces of the panel with the convexly curved end faces directed to the outer surface.

4. A composite armor according to claim 2, further comprising an inner layer adjacent said inner surface of said panel, said inner layer being formed from a plurality of adjacent layers, each layer comprising a plurality of unidirectional coplanar anti-ballistic fibers embedded in a polymeric matrix, the fibers of adjacent layers being at an angle of between about 45° to 90° to each other.

5. A ballistic armor material for absorbing and dissipating kinetic energy from high velocity projectiles, comprising a panel provided with a layer of a plurality of high density ceramic bodies, said bodies having a specific gravity of at least 2 and being made of a material selected from the group consisting of ceramic material which does not contain aluminium oxide and ceramic material having an aluminium oxide content of not more than 80%, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel.

6. A composite armor according to claim 1, wherein the ratio D/R between the diameter D of said cylindrical body and the radius R of curvature of said at least one convexly curved end face is at least 0.85:1.

7. A composite armor according to claim 1, wherein the ratio D/R between the diameter D of said cylindrical body and the radius R of curvature of said at least one convexly curved end face is between 0.84:1 and 1.28:1.

8. A composite armor according to claim 1, wherein the ratio D/R between the diameter D of said cylindrical body and the radius R of curvature of said at least one convexly curved end face is at least 1.28:1.

9. A composite armor according to claim 1, wherein each of said ceramic bodies are made of a material selected from the group consisting of boron carbide, titanium diboride, silicon carbide, magnesium oxide, silicon aluminum oxynitride and mixtures thereof.

10. A composite armor according to claim 1, wherein each of said ceramic bodies are made of silicon aluminum oxynitride.

11. A composite armor according to claim 1, wherein the relative ratios H/D/R of the height H of said cylindrical body, excluding the height of said convexly curved end face, the diameter of said cylindrical body D, and the radius R of curvature of said at least one convexly curved end face is between about 7.5:12.8:9 and 7.5:12.8:20.

12. A composite armor according to claim 1, wherein said ceramic bodies are provided with two convexly curved end faces, wherein the ratio D/R between the diameter D of said cylindrical body and the radius R of curvature of each of said convexly curved end faces is at least 0.64:1.

13. A composite armor according to claim 2, wherein each of said ceramic bodies are made of a material selected from the group consisting of boron carbide, titanium diboride, silicon carbide, magnesium oxide, silicon aluminum oxynitride and mixtures thereof.

* * * * *